US005183335A

United States Patent [19]

Lang et al.

[11] Patent Number: 5,183,335

[45] Date of Patent: Feb. 2, 1993

[54] HYDRAULIC JET FLASH MIXER WITH FLOW DEFLECTOR

[75] Inventors: John S. Lang, Arcadia; R. Rhodes Trussell, Pasadena; Susumu Kawamura, San Gabriel, all of Calif.

[73] Assignee: James M. Montgomery Engineers, Inc., Pasadena, Calif.

[21] Appl. No.: 650,770

[22] Filed: Feb. 4, 1991

[51] Int. Cl.[5] ..... B01F 5/18; B01F 5/04

[52] U.S. Cl. ..... 366/174; 366/159; 366/182; 366/338

[58] Field of Search ..... 366/150, 152, 159, 160, 366/162, 167, 171, 173, 174, 176, 136, 137, 336, 338, 182, 340; 137/888, 896; 239/432, 570, 318, 516, 523; 210/738, 205

[56] References Cited

U.S. PATENT DOCUMENTS

| | | | |
|---|---|---|---|
| 1,668,136 | 5/1928 | Agthe | 366/167 |
| 1,901,806 | 3/1933 | Fulton | 239/432 |
| 2,021,092 | 11/1935 | Teliet | 366/174 |
| 3,271,304 | 9/1966 | Valdespino et al. | 210/15 |
| 3,376,023 | 4/1968 | Lage | 366/174 |
| 3,606,272 | 9/1971 | Bergstedt | 366/171 |
| 3,675,901 | 7/1972 | Rion | 259/4 |
| 3,735,778 | 5/1973 | Garnier | 137/604 |
| 3,775,314 | 11/1973 | Beitzel et al. | 210/63 |
| 4,014,526 | 3/1977 | Cramer | 366/171 |
| 4,085,462 | 4/1978 | Booy | 366/340 |
| 4,114,195 | 9/1978 | Dirksing | 366/167 |
| 4,347,141 | 8/1982 | Rothberg | 210/378 |
| 4,549,813 | 10/1985 | Volz | 366/167 |
| 4,564,298 | 1/1986 | Gritters | 366/167 |
| 4,633,909 | 1/1987 | Louboutin et al. | 137/888 |
| 4,715,393 | 12/1987 | Newton | 366/177 |
| 4,721,126 | 1/1988 | Horii | 137/888 |
| 4,812,049 | 3/1989 | McCall | 366/174 |
| 4,859,071 | 8/1989 | Woilles | 366/173 |
| 4,869,595 | 9/1989 | Lang | 366/137 |
| 4,991,780 | 2/1991 | Kannan | 239/516 |

FOREIGN PATENT DOCUMENTS

| | | | |
|---|---|---|---|
| 2385438 | 3/1977 | France | 366/167 |
| 1211361 | 11/1983 | U.S.S.R. | 366/336 |
| 1498545 | 8/1989 | U.S.S.R. | 366/340 |

OTHER PUBLICATIONS

Vrale, et al., "Rapid Mixing in Water," *Jour. AWWA*, Jan., 1971, pp. 52–58.

"Particle Destabilization and Flocculation Reactions in Turbulent Pipe Flow," by Klute et al., in *Mixing in Coagulation and Flocculation*, ed. by Amirtharaja et al., 1991, cover page, title page, and pp. 217, 224, 230 and 255.

Lang et al., "Improvements in Flash Mixer Design", AWWA Annual Conference in Orlando, Florida, Jun. 1988.

*Primary Examiner*—Harvey C. Hornsby
*Assistant Examiner*—Terrance R. Till
*Attorney, Agent, or Firm*—Christie, Parker & Hale

[57] ABSTRACT

A hydraulic jet flash mixer in a system for treating waste water jets a secondary flow of water through a high-velocity nozzle towards a deflector assembly. In one embodiment, the deflector assembly is formed by a tip and a body, and the tip is spaced from, but spring biased toward, the body. The space between the tip and body acts as a nozzle for radially injecting a coagulant fed to the body by a pressurized supply line. In another embodiment, the deflector assembly is one piece, and the supply line is inside of and extends through the high-velocity nozzle such that coagulant is injected from a point between the nozzle and the deflector assembly.

31 Claims, 5 Drawing Sheets

HYDRAULIC JET FLASH MIXER WITH FLOW DEFLECTOR

FIELD OF THE INVENTION

This invention relates to mixing chemicals in a fluid stream and more particularly to hydraulic diffusion flash mixing of coagulants in water treatment and waste water treatment.

BACKGROUND OF THE INVENTION

Chemical coagulants have long been used in the treatment of water and waste water to induce flocculation of particles suspended in the raw water to be treated. This aggregation of suspended particles allows for more efficient sedimentation and/or filtering downstream. For best results, the initial mixing of the chemical coagulant with the raw water should occur as rapidly as possible to form a homogenized mixture within one or two seconds.

The principal objective of this rapid or flash mixing is to ensure a homogeneous coagulation by completely uniform dispersion of the coagulant throughout the water. In this way, the coagulant can make contact with the maximum number of suspended particles prior to the completion of hydrolysis, enabling intermediate complexes to destabilize the suspended particles initiating aggregation. This chemistry of destabilization sets some of the requirements for efficient rapid mixing.

Chemical coagulants should be dispersed in an unblended stream of raw water. Dispersing chemicals into a blended or partially blended stream (backmixing) can lead to poor destabilization of a fraction of the particles because some might have insufficient surface coverage while others might have too extensive surface coverage by adsorbed chemical species. This wastes chemicals and results in less effective floc formation for a given amount of a coagulant.

Stagnation time, defined as the amount of time that elapses from the addition of a coagulant to the start of mixing, should be reduced for most effective coagulation.

From a mechanical point of view, a rapid mixing device should be simple, practical and relatively inexpensive and should not create appreciable head losses.

Through the years, in attempting to meet these chemical and mechanical requirements, many devices have been employed to provide the rapid mixing needed for chemical dispersion. These include the weir, the Parshall Flume, rapid mixing chambers equipped with mechanical rotary mixing devices such as propellers or turbines and in-line blenders. More recently, hydraulic diffusion flash mixing has been used as a method providing rapid mixing without appreciable head losses and lower operating and maintenance costs than mechanical methods. This method also provides more efficient rapid mixing with reductions of 20 to 30 percent in chemical coagulant consumption over mechanical methods.

Generally hydraulic diffusion flash mixing operates by drawing off a portion of the raw water to be treated into a carrying water loop. The chemical coagulant to be dispersed is added to this drawn off portion. The mixture of raw water and coagulant is then injected into the remainder of the raw water through a diffuser. A pump in the carrying water loop provides the pressure for injection.

Usually the diffuser is a radial jet diffuser which injects the raw water and coagulant mixture perpendicular to the flow direction of the remaining raw water from several nozzles equally spaced about the circumference of a tube placed in the center of the pipe carrying the remaining raw water. Radial injection can also occur by injection perpendicular to the flow direction from nozzles equally spaced about the pipe periphery. In theory, this alternative reduces head losses, but is more difficult to construct, so central injection is preferred.

Sometimes the diffuser is a conical jet diffuser which injects the raw water and coagulant mixture parallel to the flow direction of the remaining raw water through a single nozzle, directed either upstream or downstream with the flow, located in the center of the pipe carrying the remaining raw water. Both of these options are versions of the central injection scheme. Because flow through a conical nozzle requires more power than the convergent nozzle used in the radial jet, and because the water leaving the conical nozzle does not flow entirely perpendicular to the direction of the raw water, thus causing a degree of backmixing, the radial jet diffuser is preferred over these options.

Problems have developed with hydraulic flash diffusion mixing in some applications. Where hardness exists in the raw water to be treated, addition of coagulant in the carrying water loop has led to clogging of the diffuser nozzles. This clogging requires periodic plant shutdowns to clean the diffuser, resulting in greatly increased operating and maintenance costs.

A hydraulic diffusion flash mixing system in which coagulant is directly introduced into the raw water flow is disclosed in U.S. Pat. No. 4,869,595 to Lang. In this system, raw water flows in the main pipe, and a portion of this water is diverted and reintroduced into the main pipe by a narrow auxiliary pipe. The auxiliary pipe's outlet is formed by numerous small nozzles around the periphery of the auxiliary pipe for injecting raw water perpendicular to the main raw water flow direction. A coagulant feed pipe leads to a manifold positioned around the auxiliary pipe adjacent the nozzles. The manifold has its own nozzles which surround the auxiliary pipe and inject coagulant in the direction of the main raw water flow, i.e., perpendicular to the direction of the auxiliary raw water flow so that the coagulant flow and auxiliary water flow mix and at the same time mix with the main water flow. However, the numerous injection nozzles create a relatively complex structure and are not immune from clogging due to particulate impurities in the coagulant. This is so because of the relatively small volume of the coagulant flow in relation to raw water flow, on the order of a million times less, and because the coagulant nozzles must be small enough so that the headloss through them is high enough to ensure that coagulant is properly dispensed through each coagulant nozzle.

SUMMARY OF THE INVENTION

The present invention promotes efficient mixing of coagulant with raw water not only by directly injecting coagulant into a main raw water stream, but also by subjecting the coagulant at the point it is introduced into the main water stream to turbulence created by a water supply pipe having a jet nozzle to supply a high-velocity water stream. More specifically, raw water flows through a main pipe, and a secondary pipe and the high-velocity nozzle injects a secondary flow of raw water into the main flow and in the same direction as the main flow. A deflecting device positioned just downstream of the jet nozzle intersperses the high-velocity flow with the main flow by deflecting the high-velocity flow radially outward in all directions. Coagulant passes through a small supply line into the deflecting device and exits adjacent a tip of the deflecting device in a direction perpendicular to the high-velocity flow. Accordingly, the coagulant and high-velocity flows mix within the main flow and are further dispersed by the deflecting device.

In a preferred embodiment, the deflector's nozzle has an adjustable outlet controlled by the coagulant flow. The tip of the deflecting element is spring biased in a direction to close the deflector's nozzle, such that the greater the coagulant flow, the greater the size of the nozzle opening, and the smaller the coagulant flow, the smaller the size of the opening. This achieves more uniform coagulant flow out of the nozzle and protects against clogging due to coagulant particulate contamination, as a particle lodged in the opening will cause the opening to become wider due to increased coagulant pressure.

In another embodiment, the coagulant, rather than being introduced through the deflecting element, is introduced into the jet water flow by extending the coagulant conduit into the water feed pipe and through the jet nozzle so that coagulant is discharged between the nozzle and the deflecting device.

DETAILED DESCRIPTION OF THE PREFERRED EMBODIMENT

This invention relates broadly to the mixing of one or more chemicals in a fluid stream. However, it will be disclosed in a system for treating raw water, e.g., waste water, where a coagulant, such as alum, is mixed with water to induce flocculation of the suspended particles. As explained in the Background section, such mixing preferably should occur very quickly. Hydraulic diffusion flash mixing is often used to mix raw water and coagulant because it is efficient.

Figure 1:
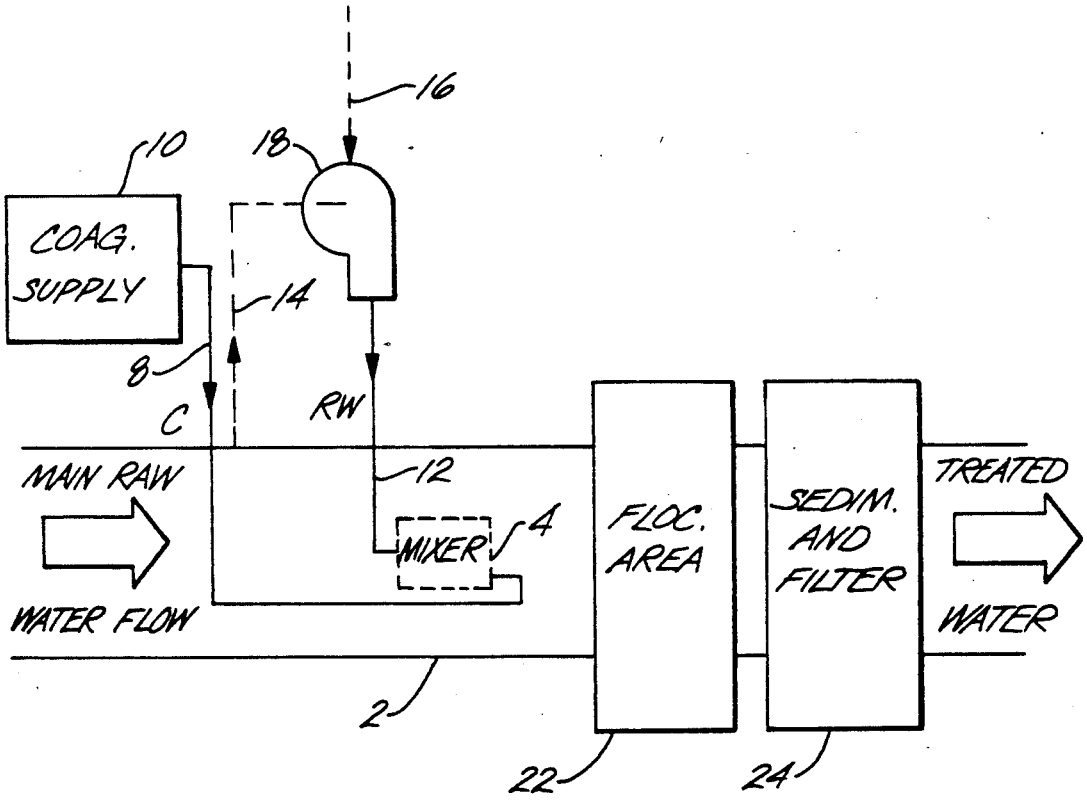
FIG. 1 is a schematic illustration of a water treatment system in which the inventive mixer is being used.

In the system as shown in FIG. 1, a main raw water flow passes through a main conduit, such as a pipe 2. The main flow encounters a mixer 4, according to the invention, where a chemical, such as coagulant, is added or mixed into the water to induce flocculation. The mixer 4 receives coagulant C along a feed pipe or conduit 8 from a supply 10 and also receives raw water RW from a secondary pipe or conduit 12. This secondary raw water flow is preferably drawn off from the main raw water flow from a point upstream (to avoid backmixing) of mixer 4, by pipe 14 shown in dashed lines, or drawn from a separate source through a pipe 16, also shown in dashed lines. This raw water is supplied by a pump 18.

Water supplied by pump 18 is preferably at high pressure and so is the coagulant from supply 10. The coagulant may be treated as in U.S. Pat. No. 4,869,595, incorporated by reference herein, in which the supply is received from a storage tank and pumped through a strainer and filter before being pumped to a mixing device. The pressurized coagulant and secondary water flow enter mixer 4 where they are mixed along with the main raw water flow. After mixing, the main flow with the coagulant enters a flocculation area 22 for relatively slow mixing to promote flocculation. Then, the water goes through sedimentation and filtering both indicated by a box labeled 24. Treated water TW emerges.

Figure 2:
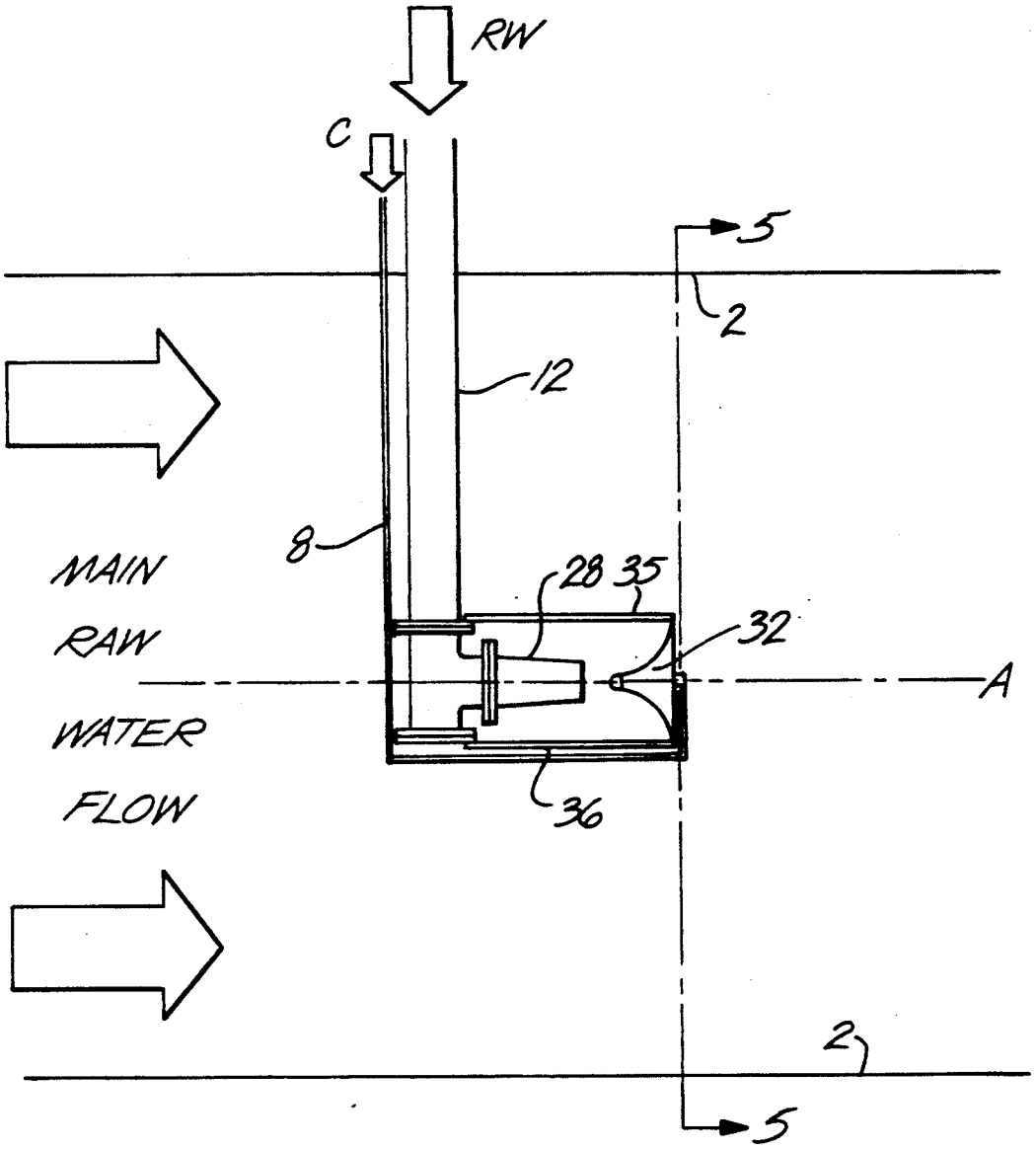
FIG. 2 shows a first embodiment of the inventive mixer in which coagulant is introduced into a deflecting device of the mixer.

FIG. 2 shows details of flash mixer 4, which is formed by a high-velocity water jet nozzle 28 and a deflecting device or assembly 32. Nozzle 28 injects raw water in a downstream direction and is preferably positioned on a central axis A of conduit 2. The nozzle is preferably a convergent jet nozzle such as used on fire hoses. Two rods 35,36, attached to pipe 12, support deflector assembly 32 in front of the nozzle along the centerline of the nozzle and thus on axis A. While the illustrated embodiment has two rods, fewer or more may be used. In addition, the deflector assembly 32 can be supported in front of the jet nozzle 48 by rods connected to the conduit 2 or by other means.

The shape of the deflector assembly is a surface of rotation about an axis coincident with the centerline of nozzle 28 which all preferably lie on central axis A. This deflector assembly shape will form the water jet into a hollow cone with circular symmetry around the axis of rotation of the deflector assembly, and is preferred for use in a conduit of circular cross section. The shape of the deflector assembly may vary to deflect the water jet into other shapes, especially in the case of conduits which have noncircular cross sections.

In general, it is preferred that the deflector shape be such that the water jet's momentum is not appreciably reduced, and such that the jet be directed transverse, i.e., perpendicular, to the main flow.

As noted above, flash mixer 4 is shown with its centerline coincident with that of conduit 2 and the water jet is in the same direction as the main water flow. While this embodiment is preferred, placement of the mixer in relation to the axis of conduit 2 may be varied.

Figure 3:
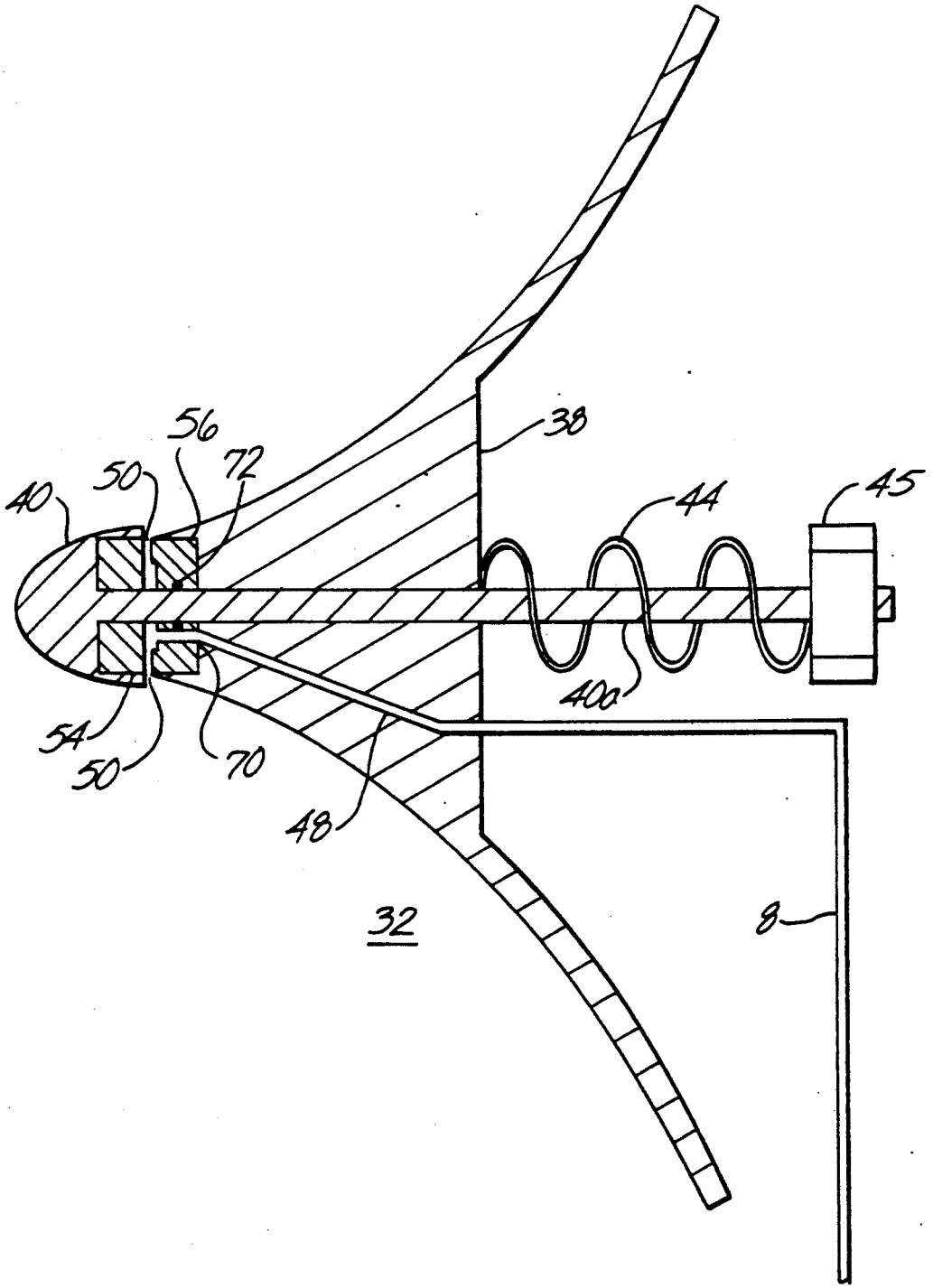
FIG. 3 is an enlarged sectional view of the deflecting element of the mixer of FIG. 2.

The deflector assembly 32 is shown in detail in the enlarged cross sectional view of FIG. 3. Deflector 32 has a body 38 and a nose piece or tip 40. The tip integrally attaches to, or is formed in one piece with, a rod 40*a* slidably fitted through body 38. A spring 44 applies a force on the tip 40 which tends to draw the tip and body together. A nut 45 threads onto rod 40*a* for adjusting spring tension.

Coagulant flows through conduit 8 into a coagulant passage 48 formed in body 38, which leads to an opening 50 between tip 40 and body 38. The conduit 8 is preferably threaded into passage 48. Most preferably, conduit 8 includes a straight pipe for threading into passage 48 to avoid having to turn the entire deflector assembly, or the entire conduit 8, and the straight pipe connects by means of a fitting to the rest of conduit 8.

Opening 50 serves as a nozzle defined by first and second nozzle blocks 54, 56 fitted in machined recesses in the tip and body, respectively. An O-ring 70 at the junction of coagulant passage 48 and second nozzle block 56 and another O-ring 72 between the second nozzle block 56 and rod 40*a* prevent coagulant leakage.

Deflector body 38, tip 40, and conduit 8 are preferably made of an alloy which is resistant to corrosion by coagulants, such as Carpenter 20 Stainless Steel. The first and second nozzle blocks 54, 56 have their surfaces which contact coagulant made of a material with a low coefficient of surface adhesion, such as TEFLON, a registered trademark of Dupont de Nemours & Company. The rest of the blocks can also be made of Carpenter 20 Stainless Steel.

The surfaces of tip 40 and deflector body 38 which deflect the water jet are shown as elliptical surfaces of rotation for illustrative purposes. The surfaces may be topologically transformed without changing the basic mixing properties of the flash mixer according to the invention.

Figure 4:
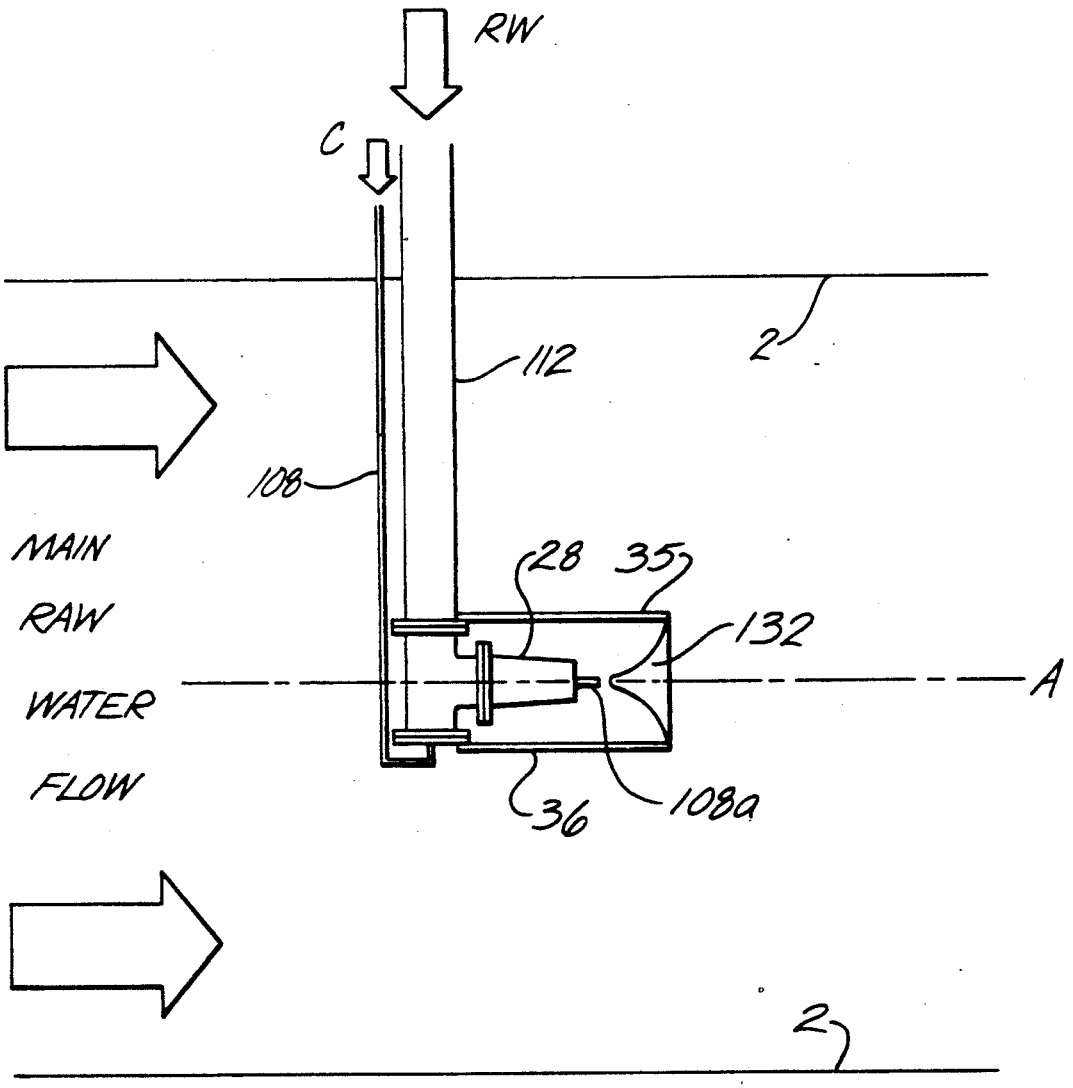
FIG. 4 shows a mixer according to a second embodiment of the invention in which coagulant is introduced upstream of a deflecting device.

A second embodiment of the inventive mixer is shown in FIG. 4 in which like parts are labeled with like reference numerals. The mixer is the same as previously described, except that coagulant conduit 108 enters water pipeline 112 at a point upstream of nozzle 28. Conduit 108 then runs along the nozzle's centerline and has its outlet 108*a* at a point between the end of the water jet nozzle and the tip of deflector assembly 132. Assembly 132 is preferably formed in one piece having substantially the same shape as assembly 32.

OPERATION OF THE INVENTION

Figure 5:
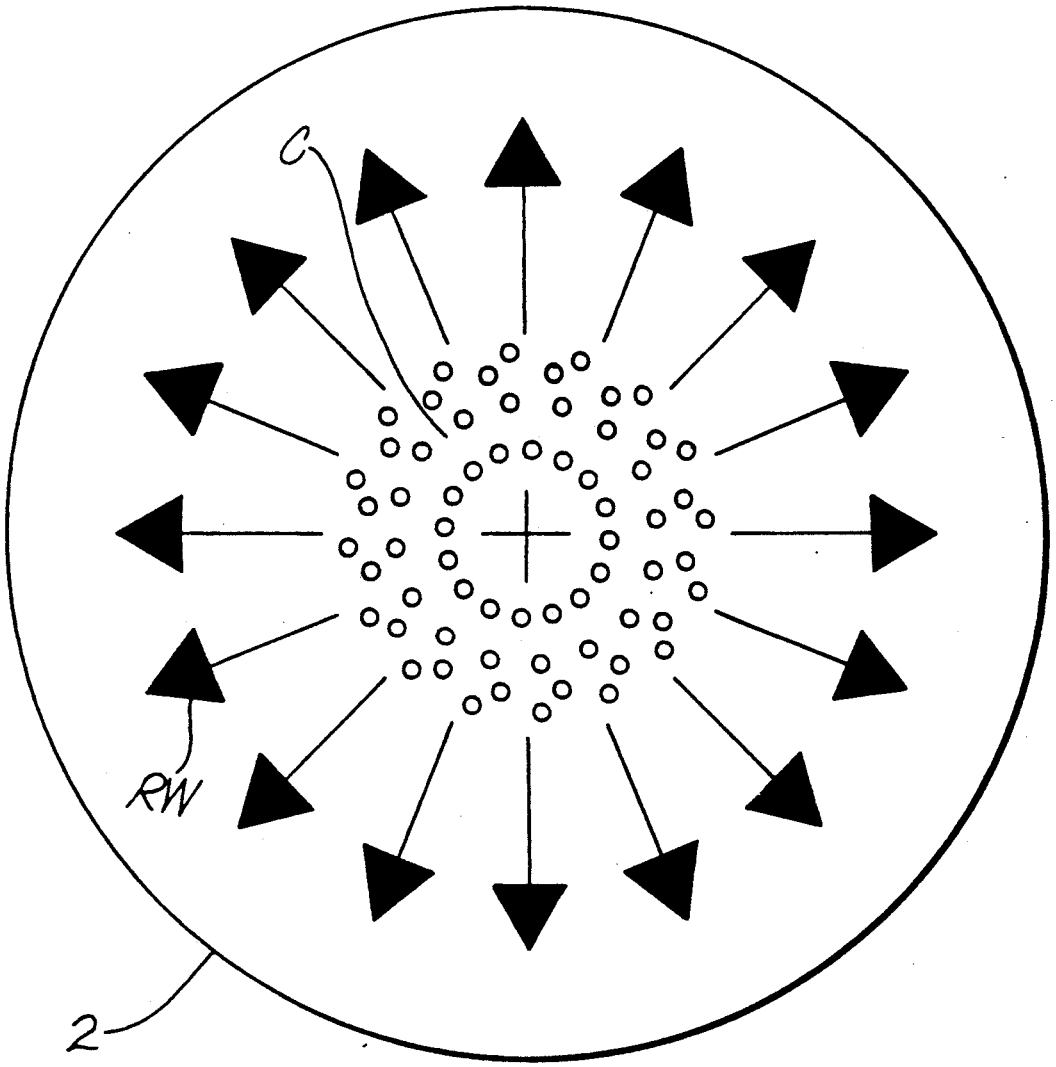
FIG. 5 is a schematic sectional view of a conduit taken along line 5—5 of FIG. 1 to show how jetted water and coagulant disperse throughout the conduit.

In the first embodiment, raw water flows through the secondary pipe 12 to the water jet nozzle where the potential energy of the water jet stream is converted into kinetic energy by the convergent nozzle 28. The injected water jet strikes the deflector assembly and has its momentum changed such that the jet becomes a desired pattern, in this case, a radially expanding sheet of water directed towards the boundary of conduit 2, as shown in the schematic sectional view of FIG. 5 taken along line 5—5 of FIG. 1. Since the deflector assembly is at rest relative to the water jet nozzle and since the drag force of the deflector on the water jet is negligible in comparison to the kinetic energy of the jet, the radially expanding water jet leaves the boundary of the deflector with the same kinetic energy imparted to it by the water jet nozzle. This kinetic energy is converted into mixing energy through vortex formation. These vortices are formed when the jet water transfers momentum to the cross flow, i.e., the main flow direction (perpendicular to the pipe for FIG. 5), in the conduit. Momentum transfer takes place both in the volume of water swept out by the diverging water jet as it travels toward the conduit boundary and by vortices shed from the diverging water jet and swept downstream by the main flow current. As shown in FIG. 5, the coagulant C mixed into the water jet is carried by the jet as it travels toward the conduit boundary.

Ideally, the incremental flow along any radial line from the axis A will be proportional to the distance along that line from the axis A to the conduit boundary. Therefore, for a circular conduit, the shape of the deflector is such that the flow is uniform in all radial directions. For noncircular conduits, the deflector should be shaped to achieve proportionally greater flow in those radial directions where the distance from the axis to the boundary is greater. For example, for a square conduit, flow should increase as the radial direction goes from the center of each side towards a corner. However, as a practical matter, a deflector shape yielding a symmetrical or uniform flow distribution should generally be sufficient to achieve relatively uniform mixing.

In contrast to the disclosure of U.S. Pat. No. 4,869,595, there is a deflector assembly 32 which is used to disperse jet flow and coagulant uniformly across the main flow direction. This avoids the complexity of multiple nozzles for water and coagulant. Moreover, in the first embodiment, the coagulant nozzle has a variable opening 50. The size of opening 50 is controlled by the coagulant flow rate through it and the tension in spring 44. The opening between the first and second nozzle blocks 54, 56 is such that the coagulant flows through the opening in a direction normal to a cylindrical surface connecting the periphery of the first and second blocks with a center of mass coincident with the axis of conduit 2. As the area of the surface is regulated by the hydrodynamic forces of the coagulant flowing through it, and the faces of the blocks adjacent and normal to the cylindrical surface are flat and parallel, the coagulant flux per unit area of the opening is equally distributed over the entire cylindrical surface. Thus, the coagulant, or other reagent, is uniformly mixed into the water jet and thereafter carried by the jet stream in the radially expanding sheet so that it is uniformly mixed into the cross flow through the conduit.

In addition to uniform distribution of flow, the coagulant nozzle is resistant to clogging. Any coagulant or contaminant particles which become trapped at the opening will be blocking a portion of the flow path through the opening. The effect of such blocking is to increase the pressure between the nozzle blocks, thus forcing them further apart until the particle is dislodged. Any additional cleaning required can be effected by forcing a large flow of water or other cleaning fluid through the coagulant conduit 8 to increase the size of the opening and flush it at greater velocities than those which can be attained by the coagulant feed pumps.

The operation of the second embodiment is similar to that of the first embodiment, except that coagulant is introduced before the water jet reaches the deflector. The spatial positioning of the end of the coagulant conduit 8 and the deflector tip are controlled so that the dispersion of the coagulant by the tip into the water jet is uniform around the centerline of the water jet nozzle and deflector assembly.

It should be noted that the nozzle 108*a* of the coagulant pipe 108 is preferably of a type resistant to clogging, such as the pintle nozzle illustrated and described in U.S. Pat. No. 4,869,595.

The foregoing disclosure and drawings are merely illustrative of this invention and are not to be interpreted in a limiting sense. The invention is described by the claims.

We claim:

1. Apparatus for injecting and mixing coagulant into a liquid stream by flash mixing comprising:

a) a conduit for carrying the liquid stream without coagulant in a first direction;

b) injection means having an outlet for injecting a fluid jet stream into the liquid stream;

c) means for drawing off a portion of the liquid stream from a predetermined position along the conduit and for supplying the drawn-off portion to the injection means to form the fluid jet stream;

d) a deflector disposed proximate to and downstream of the outlet for deflecting the fluid jet stream in a second direction transverse to the first direction of the liquid stream; and e) means for introducing coagulant directly into the fluid jet stream downstream of the outlet of the injection means for injecting such that the coagulant is carried by the fluid jet stream which is deflected in the second direction for mixing into the liquid stream, wherein the predetermined position is upstream of the means for introducing, such that conduit is adapted for carrying the liquid stream with the coagulant mixed therein away from the means for introducing and the deflector, thereby avoiding backmixing.

2. The apparatus of claim 1, wherein the means for introducing injects the coagulant from an outlet supported inside the fluid jet stream.

3. The apparatus of claim 1, wherein the injection means for injecting injects the fluid jet stream in the first direction.

4. The apparatus of claim 1, wherein the injection means for injecting comprises a high-velocity jet n the outlet thereof.

5. The apparatus of claim 1, wherein the fluid jet stream has a central axis, and the means for deflecting has a tip portion aligned with the central axis of the fluid jet stream.

6. The apparatus of claim 5, wherein the means for introducing injects the coagulant from an outlet supported inside the fluid jet stream and towards the tip portion of the deflector, the outlet of the means for introducing having a central axis aligned with the tip portion.

7. The apparatus of claim 6, wherein the deflector has a shape defined such that the fluid jet stream and coagulant are deflected in a symmetrical pattern.

8. The apparatus of claim 7, wherein the second direction is normal to the first direction.

9. The apparatus of claim 1, wherein the conduit is a first conduit, the injection means for injecting comprises a second conduit, and the means for introducing comprises a third conduit having at least a portion thereof disposed within the second conduit and extending through the outlet of the second conduit toward the means for deflecting.

10. The apparatus of claim 9, wherein the portion of the third conduit disposed within the second conduit and extending through the outlet is concentric with the outlet of the second conduit, and the outlet of the second conduit is concentric with the first conduit.

11. The apparatus of claim 1, wherein the deflector is shaped as a surface of revolution about a central axis of the fluid jet stream.

12. The apparatus of claim 2, wherein the injection means for injecting injects the fluid jet stream in the first direction, and the means for introducing injects the coagulant in the first direction.

13. The apparatus of claim 5, wherein the injection means for injecting injects the fluid jet stream in the first direction.

14. The apparatus of claim 10, wherein the injection means for injecting injects the fluid jet stream in the first direction.

15. The apparatus of claim 1, further comprising a flocculation unit downstream of the deflector, wherein the conduit is adapted for carrying the liquid stream with the coagulant to the flocculation unit.

16. Apparatus for injecting and mixing coagulant in a liquid stream by flash mixing comprising:

a) a conduit for carrying the liquid stream without coagulant in a first direction;

b) injection means having an outlet for injecting a fluid jet stream into the liquid stream;

c) means for drawing off a portion of the liquid stream from a predetermined position along the conduit and for supplying the drawn-off portion to the injection means to form the fluid jet stream;

d) a deflector disposed proximate to and in front of the outlet for deflecting the fluid jet stream in a second direction transverse to the first direction of the liquid stream; and e) means for conveying the coagulant under pressure into the deflector, wherein the deflector has an opening defined therein, in communication with the means for conveying, for introducing the coagulant into the fluid jet stream such that the coagulant is carried in the second direction by the deflected fluid jet stream for mixing into the liquid stream, wherein the predetermined position is upstream of the means for introducing, such that the conduit is adapted for carrying the liquid stream with the coagulant mixed therein away from the means for introducing and the deflector, thereby avoiding backmixing.

17. The apparatus of claim 16, wherein the deflector comprises a tip portion and a body portion, and means for attaching the tip portion and body portion for movement relative to each other in response to a flow of the coagulant and having the opening defined therebetween such that a size of the opening varies with the flow of the coagulant, the tip portion being disposed so as to face the outlet of the injection means for injecting.

18. The apparatus of claim 17, wherein the deflector further comprises means for biasing the tip and body portions towards each other.

19. The apparatus of claim 16, wherein the injection means for injecting injects the fluid jet stream in the first direction.

20. The apparatus of claim 16, wherein the injection means for injecting comprises a high-velocity jet nozzle at the outlet thereof.

21. The apparatus of claim 16, wherein the injection means for injecting and the deflecting for deflecting have central axes which are aligned.

22. The apparatus of claim 16, wherein the deflector has a shape such that the fluid jet stream is deflected in a symmetrical pattern.

23. The apparatus of claim 16, wherein the second direction is normal to the first direction.

24. The apparatus of claim 16, wherein the deflector is shaped as a surface of revolution about a central axis of the fluid jet stream.

25. The apparatus of claim 16, further comprising a flocculation unit downstream of the deflector, wherein the conduit is adapted for carrying the liquid stream with the chemicals to the flocculation unit.

26. Apparatus for injecting and mixing chemicals into a liquid stream by flash mixing comprising:

a) a conduit having a predetermined cross-sectional area for carrying the liquid stream in a first direction through the predetermined cross-sectional area, with respect to the first direction, wherein the conduit has a central axis extending in the first direction;

b) injection means having an outlet for injecting a fluid jet stream into the liquid stream;

c) means for drawing off a portion of the liquid stream from a predetermined position along the conduit and for supplying the drawn-off portion to the injection means to form the fluid jet stream;

d) a deflector disposed proximate to and downstream of the outlet for deflecting and dispersing the fluid jet stream in a plane normal to the first direction of the liquid stream such that the fluid jet stream disperses radially throughout the cross-sectional area; and e) means for introducing chemicals directly into the fluid jet stream downstream of the outlet of the injection means for injecting, whereby the chemicals are dispersed radially throughout the cross-sectional area by the deflected fluid jet stream, wherein the predetermined position is upstream of the means for introducing, such that the conduit is adapted for carrying the liquid stream with coagulant mixed therein away from the means for introducing and the deflector, thereby avoiding back-mixing.

27. The apparatus of claim 26, wherein the fluid jet stream has a central axis, and the deflector has a tip portion aligned with the central axis of the fluid jet stream.

28. The apparatus of claim 27, wherein the means for introducing injects the chemicals from an outlet supported inside the fluid jet stream and towards the tip portion of the deflector, the outlet of the means for introducing having a central axis aligned with the tip portion.

29. The apparatus of claim 28, wherein the deflector has a shape defined such that the fluid jet stream and chemicals are deflected in a symmetrical pattern.

30. The apparatus of claim 29, wherein the second direction is normal to the first direction.

31. Apparatus for injecting and mixing chemicals in a liquid stream comprising:

a) means for carrying the liquid stream in a first direction;

b) means having an outlet for injecting a fluid jet stream into the liquid stream;

c) means disposed proximate to and in front of the outlet for deflecting the fluid jet stream in a second direction transverse to the first direction of the liquid stream; and d) means for conveying the chemicals under pressure into the means for deflecting, wherein the means for deflecting has an opening defined therein, in communication with the means for conveying, for introducing the chemicals into the fluid jet stream, wherein the means for deflecting comprises a tip portion and a body portion, and means for attaching the tip portion and body portion for movement relative to each other with the opening defined therebetween, the top portion being disposed so as to face the outlet of the means for injecting, and wherein the means for deflecting further comprises means for biasing the tip and body portions towards each other and responsive to a flow of the chemicals such that a size of the opening varies with the flow of the chemicals.

* * * * *

UNITED STATES PATENT AND TRADEMARK OFFICE

CERTIFICATE OF CORRECTION

PATENT NO. : 5,183,335

DATED : February 2, 1993

INVENTOR(S) : John S. Lang; R. Rhodes Trussell; Susumu Kawamura

It is certified that error appears in the above-identified patent and that said Letters Patent is hereby corrected as shown below:

On the Title Page:

[56] References Cited, U.S. PATENT DOCUMENTS,
change "4,715,393 12/1987 Newton...366/177"
to -- 4,715,393 12/1987 Newton...366/167 --.

In the Claims:

Column 7, line 21, after "jet" change "n" to
-- nozzle at --.

Column 8, line 45, change "deflecting for deflecting" to
-- deflector --.

Signed and Sealed this

Twenty-eighth Day of December, 1993

*Attest:*

BRUCE LEHMAN

*Attesting Officer*

*Commissioner of Patents and Trademarks*